United States Patent [19]

Sapp

[11] Patent Number: 4,655,157

[45] Date of Patent: Apr. 7, 1987

[54] HIGH SPEED PLANING BOAT WITH CANTILEVERED PLANING SURFACE

[75] Inventor: Samuel C. Sapp, Ocala, Fla.

[73] Assignee: Marine Technological Exchange, Inc., Ocala, Fla.

[21] Appl. No.: 720,290

[22] Filed: Apr. 5, 1985

[51] Int. Cl.[4] ..... B63B 1/32

[52] U.S. Cl. ..... 114/291; 114/56

[58] Field of Search ..... 114/56, 57, 285, 286, 114/287, 288, 289, 290, 291, 67 A, 61; 440/82

[56] References Cited

U.S. PATENT DOCUMENTS

| | | | |
|---|---|---|---|
| 3,382,833 | 5/1968 | Wukowitz | 114/289 |
| 3,428,017 | 2/1969 | Altson | 440/82 |
| 4,091,761 | 5/1978 | Fehn | 114/61 |
| 4,348,972 | 9/1982 | Parsons | 114/61 |

*Primary Examiner*—Sherman D. Basinger

*Assistant Examiner*—Jesûs D. Sotelo

*Attorney, Agent, or Firm*—Hall, Myers & Rose

[57] ABSTRACT

A pleasure boat for operation at high speeds in moderate seas, and having a rectangular passenger area, planes on ski-like planing surfaces on the bottom of laterally spaced, knife edge hulls located on the starboard and port sides of the craft. The boat has a centrally symmetrical wedge commencing at the forward transom of the boat and extending to about the beginning of the planing region toward the stern of the boat and a relatively thin plate extending preferably cantilevered, from the bottom surface of the wedge to a sufficient distance forward of the rear transom to accommodate a propeller. The plate is held in a normal position by shock absorbers and a drive shaft from an inboard engine extends through a vertical wall formed by termination of the wedge to a propeller at the stern of the craft, the shaft lying between the bottom of the boat and the plate.

19 Claims, 9 Drawing Figures

FIG. 4
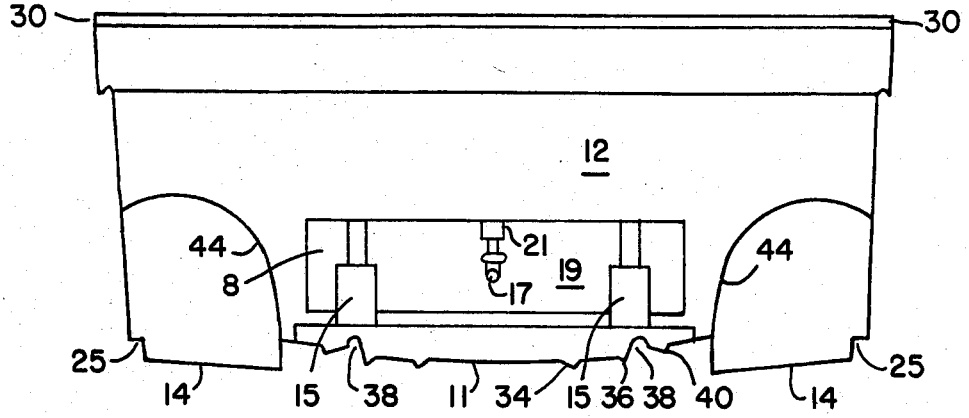
FIG. 5
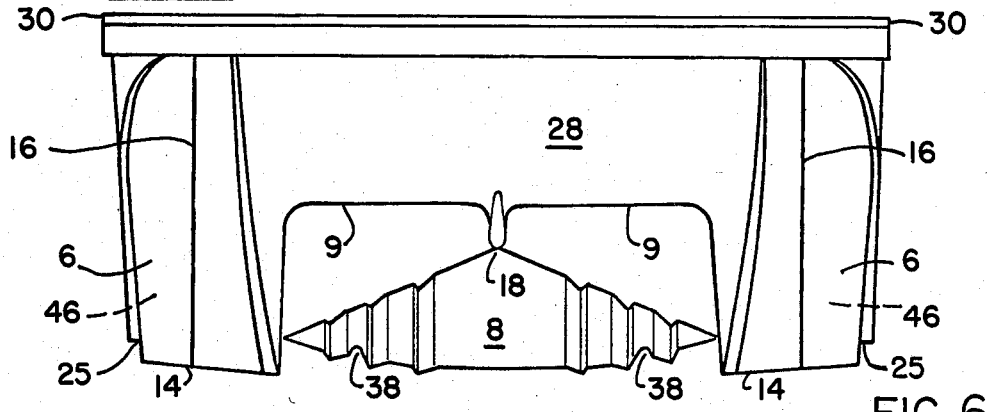
FIG. 6
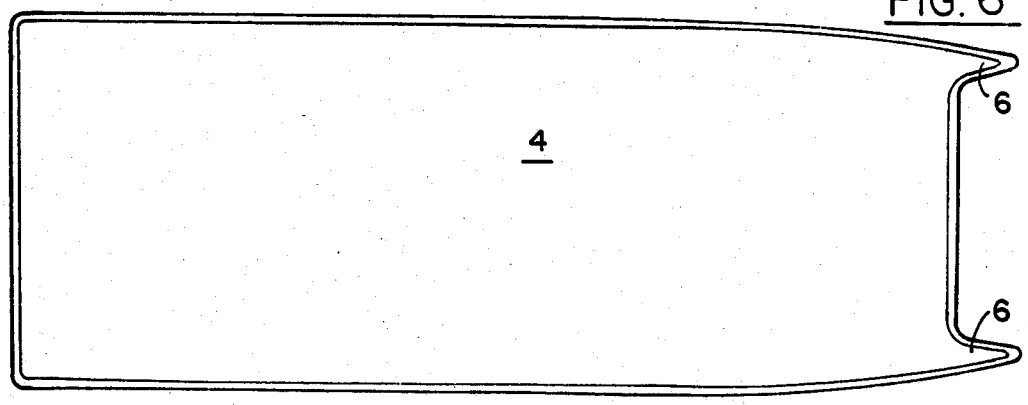
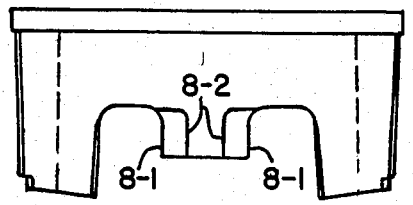
FIG. 8
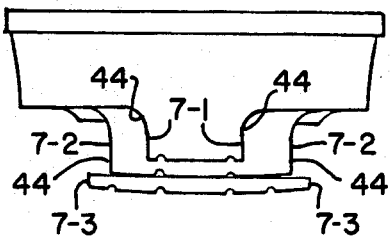
FIG. 7

HIGH SPEED PLANING BOAT WITH CANTILEVERED PLANING SURFACE

BACKGROUND OF THE INVENTION

The present invention relates to high speed pleasure boats and more particularly to a planing boat having a plate for a rear planing surface.

DESCRIPTION OF CONCURRENT ART

In concurrently filed patent application Ser. No. 720,289 in the names of Peter Payne and Samuel Sapp for High Speed Planing Boat, there is set forth a planing craft having a pair of laterally spaced symmetrical planing hulls located forward on the craft and a wedge shaped bottom having maximum width at the transom and providing a third planing surface. The forward planing hulls provide one planing surface (ski) each and have knife edge, leading edges to permit the craft to cut through waves to reduce drag; the front skis reducing the rise and fall of the craft and thus preventing the craft from falling out of equilibrium. The front hulls also carry S-shaped spray rails to direct spray from the passenger area. The S-shaped spray rails provides at its highest point near the front of the rails, deflection of high waves and as it approaches the water line diverts waves of lesser height almost down to the planing surface of the skis. The spray rails carries to just above the planing surfac and to the rear of the skis to reduce the wetted surface at planing and also breaks up the bow wave into two waves of lesser height than would otherwise be the case. A third planing surface is provided by a wedge shaped bottom of the boat with the craft planing on the tail end of such surface.

Planing hull are employed at the forward end of the craft as indicated above to decrease rocking of the craft in moderate seas and to prevent the craft from falling out of equilibrium. Further due to the use of a rectangular hill, a large proportion of the weight, one-third to one-half, is located forward of the transverse center of the craft and must be supported separately from the rear planing surface. Thus an added use of the forward planing hulls.

A single forward hull is not employed since it would adversely effect the ability to plane on the rear planing surface. Thus the two widely separated forward hulls are employed. Symmetrical hulls are employed to prevent yawing of the craft in turns and in the presence of waves striking the boat at an angle to its centerline.

The front hulls terminate in tunnels running down each side of the wedge which tunnels add lift to the craft when coming up to its planing position and during planing greatly reduce the wetted surface of the craft to only that required to produce planing. The rear of the forward planing surfaces of the hulls carry downwardly depending hooks to increase the lift of these surfaces.

The distribution of the weight of the craft over three surfaces provides a very shallow draft even at low, non-planing, speeds; the draft at rest in one such craft being 10 inches for a 3000 lb. craft.

The wedge shaped bottom of the craft is rounded to soften the ride, assist in lift and to prevent the chines of the wedge from digging into the water on turns; thus improving the ability of the craft to hold a turn. The wedge is also provided with flutes to assist in holding a heading and strakes which assist in holding a turn, and add to the lift and assist in diverting spray away from the passenger area.

The disclosure of said concurrently filed application is incorporated herein by reference.

BRIEF DESCRIPTION OF THE INVENTION

The present invention is specifically directed to easing the use of an inboard engine in the craft of the aforesaid concurrently filed application.

Specifically a rear region, perhaps as much as four feet, of the planing surface is removed down to almost the bottom surface of the boat. A plate is cantilevered from the planing surface forward of the cut-away region; the plate extending to the rear transom and being supported by shock absorbers adjacent the rear transom. The shaft of an inboard engine is brought out through the vertical wall created by the cut-away of the planing surface and extends rearwardly between the bottom of the hull and the plate. The shaft and plate may have a universal joint where it exits the aforesaid wall and is also supported near the rear transom by a shock absorber. The shaft may now be raised or lowered depending upon the boat's location; i.e. shallow or deep water with a straight drive being preferable at high speed operation.

The plate may be flat or have the rounded and otherwise configured shape of the aforesaid concurrently filed application. The shock absorbers on the plate reduce the shock due to wave action on the planing surface and provide a smoother ride than would otherwise be achieved.

BRIEF DESCRIPTION OF THE DRAWINGS

FIG. 4 is a rear view of the boat of the present invention, FIG. 5 is a front view of the craft, FIG. 6 is a top plane view of the craft, FIG. 7 is a schematic of the contours of the boat at locations 7-1 to 7-3 of FIG. 2; and FIG. 8 is a schematic of the contours at locations 8-1 to 8-2 of FIG. 2;

DETAILED DESCRIPTION OF THE PRESENT INVENTION

Figure 2:
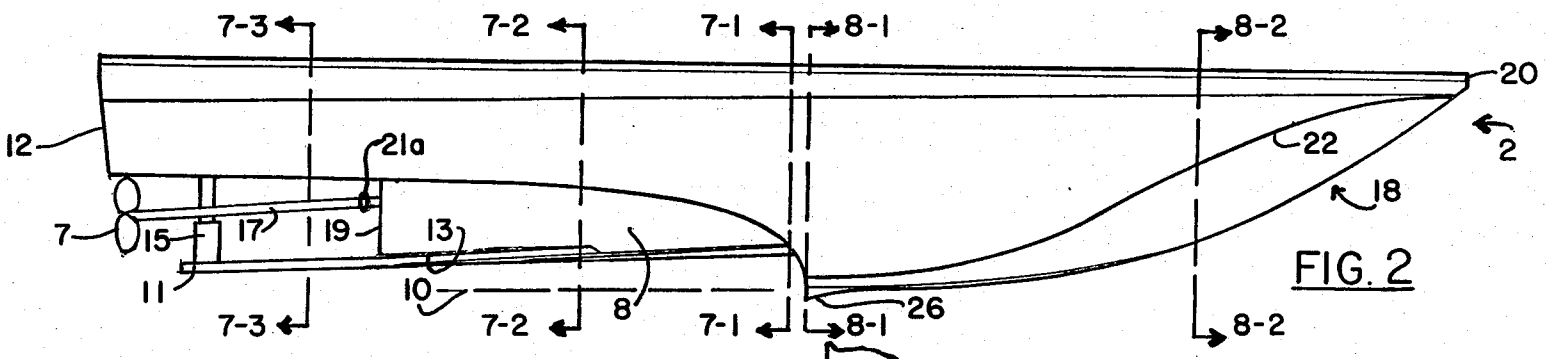
FIG. 2 is a side view in elevation of the invention.
Figure 1:
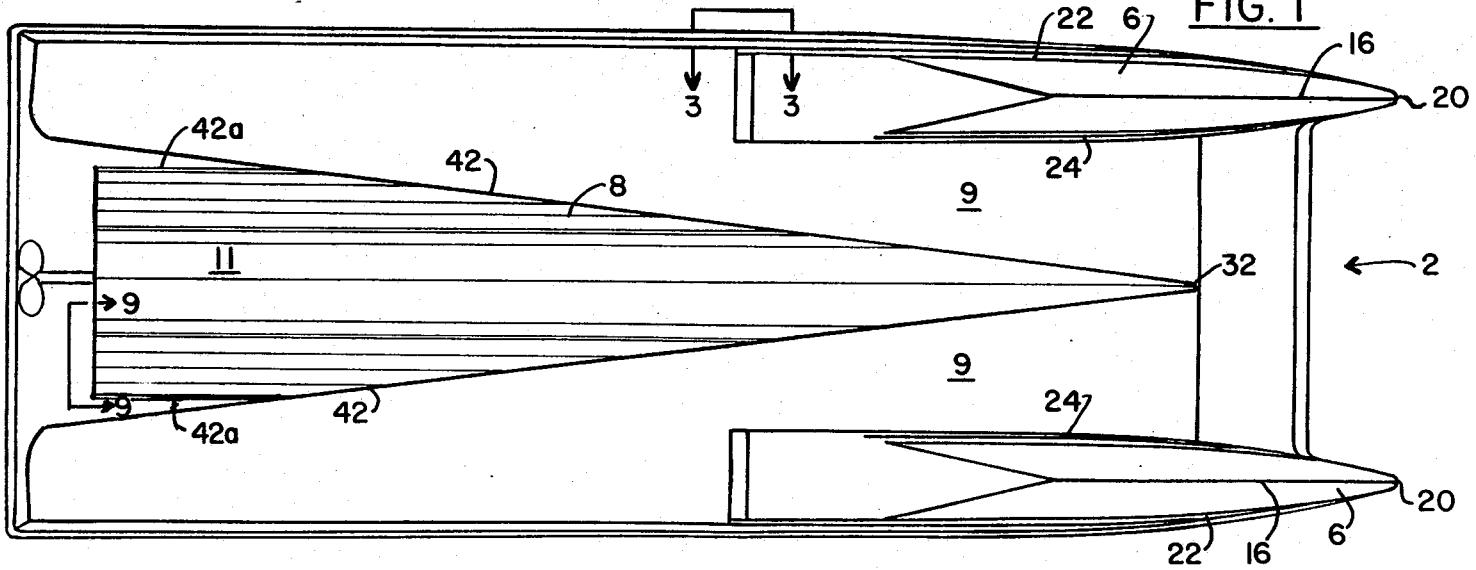
FIG. 1 is a bottom view of the boat of the present invention.

Referring now to FIGS. 1 and 2 of the accompanying drawings, the craft 2 comprises an upper, generally rectangular part 4, see FIG. 6, a pair of laterally separated front hull members 6, and a rounded wedge 8 extending along and depending downwardly from the bottom 9 of the craft. The wedge 8 is terminated approximately 20% of the length of the boat from the rear transom. A plate 11 is fitted in a recess 13 in the bottom surface of a rearward region of the wedge 8. The plate 11 is appropriately secured to the recessed surface of the wedge and extends in line with such bottom surface to a location about 12" forward of the heel of the transom 12; thus allowing space for the propeller 7. Thus the plate 11 is cantilevered off of the wedge and is provided with a pair of shock absorbers 15 preferably hydraulic, see FIG. 4. The plate 11 may be fabricated of a buoyant material to add lift and assist the boat in rising to and maintaining planing.

A propeller shaft 17 from an inboard engine pierces wall 19 at the rear of the wedge 8 and extends rearwardly of the transom 12. The shaft is provided with a universal joint 21*a* in the region of the outer surface of wall 19 and is provided with a shock absorber 21, preferably hydraulic, adjacent the transom, see FIG. 4, the shock absorber 21 being shielded from view in FIG. 1 by the plate shock absorber 15.

It can be seen that by appropriate control of the shock absorber or other mechanical devices, the plate and shaft can be raised and lowered as required by operating conditions.

The wedge 8 may be inclined between 2° and 6° to the line 10 drawn between the bottom of plate extension of the wedge 8 at transom 12 and the bottom rear of the forward hulls 6. In the specific craft being considered the angle is 4°; the same angle the bottom of the hulls 6, hereinafter referred to as the skis 14, make with line 10.

The hulls 6 are identical and thus only one is discussed. The hulls are symmetrical and have relatively sharp leading edges 16 which slope upwardly along a continuous curve 18 to a virtual point 20 at the prow of the craft.

The hulls 6 are provided with both inner and outer spray deflectors 24 and 22, the inner deflector terminating at the front of the ski region and the outer deflector carrying to the end of the ski. Both sets of deflectors 22 and 24 are S-shaped and carry from near the top front of the hulls to near the bottom at the back of the skis; thus providing spray protection for both low and high waves. As previously indicated, the fact that the outer spray rails 22 provide, in effect, a notch 25 in the outer edge of the ski that serves the threefold purpose of a spray rail, a means of reducing the wetted surface of the ski and most importantly breaks up the bow wave thus reducing the height thereof.

Figure 3:
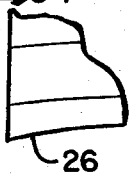
FIG. 3 is a detailed side view of the hooks at the rear of the front skis taken at lines 3—3 of FIG. 1.

The rear of skis 14, and reference is made to FIG. 3 of the accompanying drawings, is curved to provide a relatively flat downward hook 26 which provides additional lift to the front skis.

The craft has a flat bow 28 commencing rearwardly of the leading edge 20 of the hulls 6 by a short distance sufficient to permit the hulls 6 to knife into incoming waves before encountering the main body of the boat. Thus a large dynamic force that would tend to lift the bow is substantially avoided. An additional reduction in lifting force is realized by sloping the bow down and to the rear at about a 45° angle relative to upper chines 30; the bow terminating at the bottom 9 of the boat. This sloping surface provides the additional function of preventing swamping of the craft in heavy seas. If wave is encountered it will serve to raise the bow, permitting the wave to pass under the craft and down through the tunnels. The wedge 8 commences at the intersection of the bow and the bottom 9 of the craft. The wedge tapers outwardly to the rear at an angle determined by the width of the craft and the width of tunnels to be described subsequently. In the particular realization of the invention illustrated, the outward taper of each side of the wedge relative to the centerline of the craft is 7½°, going fron a virtual point 32 to about 52" at the stern transom 12. The stern of the craft in question is about 87" wide.

The wedge 8 and its extension plate 11 are illustrated as rounded in the vertical back to front view illustrated in FIG. 4 of the accompanying drawings. The radius of curvature of the bottom of the wedge and plate is about 92" for this particular craft. The bottom of the wedge and plate are provided with six aligned, longitudinally extending strakes, three, numbers 34, 36 and 38 on each side of the centerline of the craft with the innermost strake spaced apart a sufficient distance so as not to introduce significant quantities of air bubbles to the propeller. Located between strakes 38 and 40 on both sides of the centerline of the wedge 8 are longitudinally extending grooves 40 which help reduce yawing of the craft and hold it on course while providing some lift.

The strakes provide some lift during rise to planing and while on plane operate as spray diverters in the planing mode. The rounded bottom of the wedge 8 prevent chines 42 and 42*a* of the wedge 8 and plate 11, respectively, from digging into the water on turns, reducing drag and helping to hold the turn. Specifically, the rounded bottom reduces shock and allows banking to provide better turning at slow speeds; behaving like a flat bottom at high speeds. The plate 11 is preferably shaped as the wedge, but it may be a flat rectangular plate.

The sides 44 of the wedge rearward of the hulls 6 and forward of the plate 11, rise sharply and terminate in a surface of large radius, in the embodiment illustrated, a radius of about 12". These surfaces define tunnels 46 extending from the rear of the hulls 6 to the region of the plate, greatly reducing the area of the craft engaging the water, providing lift when in the water with the craft rising to the planing position and serve as spray diverters when planing. The sharp rise along the sides of the planing wedge and the lack of surfaces on the region of the plate 11 also serve to reduce the dynamic forces acting on the bottom of the craft to only those required for planing and thus do not produce excess forces that would produce unnecessary rocking of the craft.

Figure 9:
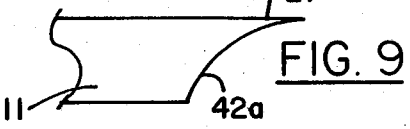
FIG. 9 is an enlarged detailed view of the edge of the plate 11 taken at lines 9—9 of FIG. 1.

Referring now to FIG. 9 of the accompanying drawings, the edges 25*a* of the plate 11, only one of which is illustrated in FIG. 9, are inclined outward and upward at an angle of approximately 45° and terminating in a projection 27 which acts as a spray deflector. The 45° angle on the edge of the plate serves the important function of helping the craft hold its turn which the spray deflection assists in keeping the passenger compartment dry and primarily in reducing wetting of the bottom of the boat.

It should be noted that although the tip of plate 11 is wetted prior to planing, at planing the plate 11 is not submerged and its top surface is not a wetted area, not even in turns due to the contour of the edge of the plate.

The craft described above has a rectangular upper shape much like a house boat and is intended for pleasure use in moderate seas but may be adapted to other uses where high speed, maneuverability and a large passenger area are desired. The length to width ratio, ideally 2:1 to 3:1 is, in this rendition, 2.68:1 and is 21 ft. long. In test of the craft of the copending concurrently filed application using a 115 horsepower outboard engine with a submerged propeller, speeds of slightly over 51 miles per hour were attained. The craft is capable of carrying a 200 horsepower outboard engine. In the tests conducted on such craft, which weighed about 3000 pounds with one person and all equipment aboard, and in waves of 1.5 feet, the craft experienced no loss of speed or efficiency. Based on the tests of the aforesaid concurrently filed application, it has been calculated that such craft and also the craft of the present invention, with a 5 cylinder Mercedes diesel engine of 130 shaft horsepower, will attain speeds of approximately 50 MPH at full throttle with fuel consumption of 10 miles per gallon and at cruising speeds, 35–40 MPH, fuel consumption of 15 MPG.

It was found that only the four feet of the planing surface, i.e. the plate 11, and one foot of each of skis 6 were in water and the front skis rode on the surface of the water. The skis in this rendition were about 16" wide. Thus the wetted surface of the craft was quite small and thus the high efficiency. The very small area of wetted surface, less than 14 square feet for a 3000 lb craft in this rendition, results from the use of the plate which has no appreciable sides and of the tunnels to reduce the wetted surface of the wedge; the height of the tunnel being effective to minimize wetting along the sides of the wedge and adjacent surfaces of the bottom of the boat. The length of the planing surface in water when planing is defined also to a great extent by the placement and angle of the front skis. In waves, the front edges of the hulls which hold the wedge at the proper angle of attack cut through the waves permitting the skis to ride the surface of the waves; the plate following whereby to reduce rocking and slapping along the bottom of the boat to relatively comfortable levels even in seas of up to three feet. It has been found that the rear of the skis should be no greater than 50% of the length of the boat from the bow thereof; specifically 10'4" in a boat of 20'11" in length. It has also been found that the shock absorbers of the plate 11 further increase the comfort by absorbing much of the dynamic forces of the wave action.

In summary, the craft planes on three surfaces such that the bow of the craft can be quite wide; the weight thereof being carried by the narrow front skis which also serve to maintain the rear planing surface at the proper angle of attack. The front of the forward hulls are knife edged to permit the craft to knife through waves instead of riding the crests and this together with the sloping bow maintains rocking in moderate seas at relatively low levels. Tunnels to the rear of the skis and along the sides of the wedge and the lack of walls of the plate 11, reduce the surface in contact with water to the minimum required to support the fully loaded craft, thus eliminating drag to a level far below that found even in the deep-V high performance hulls. The three surfaces of support permit an unusually shallow draft for a boat of such size and weight; only 10 inches in the boat that was built and tested. The craft maintains close to maximum speed in waves up to three feet. Maneuverability and turning is enhanced by the use of a rounded bottom on the wedge and plate and the use of strakes and flutes.

Depending upon desired end use of the craft, angles of attack, radius of curvature of the bottom of the wedge and plate, flat surface area of the skis and the like may be varied to accommodate specific needs. Thus it is apparent that minor variations in design are possible without violating the teachings or spirit of the present invention. The passenger area can be configured as desired with stark or luxurious fittings and controls, deck covering structures, sleeping accommodations and the like. The craft, due to its shallow draft, is ideal for lake fishing or because of speed and maneuverability for racing or warfare. For instance the ride can be softened by increasing the dead rise of the skis and/or making the bow and planing surface in a V-shape. The former modification will reduce the speed of the craft and the latter modification will reduce its efficiency but both reductions will not be greater and the ride will be noticeably smoother.

Although not illustrated since it forms no part of the present invention, the cockpit area in one form will be 101 square feet, leaving free space of 63 sq. feet in a 21 foot long craft; thus comparing favorably with craft of 30 feet or more in length.

Other improvements, modifications and embodiments will become apparent to one of ordinary skill in the art upon review of this disclosure. Such improvements, modifications, and embodiments are considered to be within the scope of this invention as defined by the following claims.

I claim:

1. A high speed, high efficiency planing boat comprising:

a passenger compartment having a bottom, a pair of forward hulls depending downwardly from said bottom of said passenger compartment, said hulls being spaced apart and lying on opposite sides of the longitudinal centerline of said boat, each said hull having a ski-like surface toward the rear thereof, a wedge-shaped member having a bottom surface and extending downwardly along said bottom of said passenger compartment with its apex lying between said hulls along the longitudinal centerline of the boat, a plate of predetermined length, said wedge shaped member terminating at a distance from the stern of said boat approximately equal to the length of said plate, said plate extending from at least the rear of said wedge shaped member to near the stern of said boat to provide a planing surface for said boat, and means for normally holding the said plate in a continuous plane with the bottom surface of said wedge shaped member and cushioning movement of said plate toward said bottom of said passenger compartment.

2. A high speed, high efficiency planing boat according to claim 1 wherein said plate is buoyant.

3. A high speed, high efficiency planing boat according to claim 1 or claim 2 wherein said means are shock absorbers.

4. A high speed, high efficiency planing boat according to claim 1 or claim 2 wherein the rear of said wedge shaped member terminates in a wall generally perpendicular to said planing surface thereof, a drive shaft extending from adjacent the transom of said boat forward through said wall into said passenger compartment.

5. A high speed, high efficiency planing boat according to claim 4 wherein said drive shaft has a universal joint adjacent said wall, and a shock absorber extending between said drive shaft and a body member of said boat to resiliently maintain said shaft in a normal drive position.

6. A high speed, high efficiency planing boat according to claim 4 wherein said drive shaft lies between said bottom of said passenger compartment and said plate.

7. A high speed, high efficiency planing boat according to claim 4 wherein said plate is cantilevered from said wedge shaped member.

8. A high speed, high efficiency planing boat according to claim 1 or claim 2 wherein said plate is cantilevered from said wedge shaped member.

9. A high speed, high efficiency planing boat according to claim 1 wherein said passenger compartment is generally rectangular.

10. A high speed, high efficiency planing boat according to claim 1 wherein said ski-like surfaces and said wedge shaped member and plate are inclined upwardly from stern to bow relative to said bottom of said boat.

11. A high speed, high efficiency planing boat according to claim 10 wherein said angle of inclination is in the range of approximately 2°-6°.

12. A high speed, high efficiency planing boat according to claim 1 or claim 10 wherein said hulls are tapered to a generally sharp downwardly and rearwardly curved leading edge, said leading edges tapering into said ski-like surfaces.

13. A high speed, high efficiency planing boat according to claim 12 wherein said hulls include spray deflectors.

14. A high speed, high efficiency planing boat according to claim 13 wherein said hulls each have along their outer surfaces an S-shaped notch having its highest point adjacent the bow thereof and extending to the rear of each said hull in a generally smooth curve to a short distance above said ski-like surface.

15. A high speed, high efficiency planing boat according to claim 14, wherein said wedge-shaped member and said plate include a bottom surface having a plurality of aligned longitudinally extending flutes disposed symmetrically with respect to the centerline of the boat.

16. A high speed, high efficiency planing boat according to claim 1, wherein said wedge-shaped member and said plate include a bottom surface having a plurality of aligned longitudinally extending flutes disposed symmetrically with respect to the centerline of the boat.

17. A high speed, high efficiency planing boat according to claim 1 wherein said ski-like surfaces are positioned to carry at least approximately one-third the weight of said boat.

18. A high speed, high efficiency boat according to claim 1, wherein said ski-like surfaces terminate at their stern end a distance from the bow of said hulls of not greater than 50% of the distance from said bow to the stern of said boat.

19. A high speed, high efficiency planing boat according to claim 1 wherein said wedge shaped member terminates approximately 20% of the length of said boat from the transom thereof.

* * * * *